US008040076B2

(12) United States Patent
Schwarz

(10) Patent No.: US 8,040,076 B2
(45) Date of Patent: Oct. 18, 2011

(54) MONITORING DEVICE

(75) Inventor: Gerhard Schwarz, Schönbrunn (DE)

(73) Assignee: Cooper Crouse-Hinds GmbH, Soest (DE)

( * ) Notice: Subject to any disclaimer, the term of this patent is extended or adjusted under 35 U.S.C. 154(b) by 372 days.

(21) Appl. No.: 12/375,880

(22) PCT Filed: Jul. 27, 2007

(86) PCT No.: PCT/EP2007/006690

§ 371 (c)(1),
(2), (4) Date: Apr. 20, 2009

(87) PCT Pub. No.: WO2008/014942

PCT Pub. Date: Feb. 7, 2008

(65) Prior Publication Data

US 2009/0261733 A1 Oct. 22, 2009

(30) Foreign Application Priority Data

Aug. 3, 2006 (DE) ..... 10 2006 036 293

(51) Int. Cl.
*H05B 41/36* (2006.01)

(52) U.S. Cl. ..... 315/291; 315/50; 315/309

(58) Field of Classification Search ..... 315/32, 315/50, 119, 127, 291, 309
See application file for complete search history.

(56) References Cited

U.S. PATENT DOCUMENTS 3,161,746 A * 12/1964 Cook et al. ..... 337/23
3,176,187 A * 3/1965 Sola ..... 315/257
4,455,509 A * 6/1984 Crum et al. ..... 315/119
5,594,304 A * 1/1997 Graber ..... 315/85
5,604,409 A * 2/1997 Fisher ..... 315/219
6,051,940 A * 4/2000 Arun ..... 315/307
6,888,324 B1 5/2005 McElroy
2007/0241693 A1* 10/2007 Chan et al. ..... 315/291
2009/0309518 A1* 12/2009 Frucht ..... 315/309

FOREIGN PATENT DOCUMENTS

DE 26 08 761 A1 9/1977
EP 0 285 049 A 10/1988
EP 0 326 079 A 8/1989

OTHER PUBLICATIONS

International Search Report (Application No. PCT/EP2007/006690), mailed Nov. 8, 2007, 2 pages.

* cited by examiner

*Primary Examiner* — Don Le
(74) *Attorney, Agent, or Firm* — Fish & Richardson P.C.

(57) ABSTRACT

A monitoring device for monitoring at least one fluorescent lamp, particularly in areas at risk of explosion, which fluorescent lamp has a lamp tube with electrodes arranged on the ends thereof in the form of coils, and lamp sockets assigned to said electrodes, is improved for preventing large temperature increases in a corresponding fluorescent lamp, particularly in areas at risk of explosion, by complying with the appropriate explosion safety measure, in that the monitoring device has at least one temperature measuring device assigned to a coil, and one electro-mechanical interruption device with which the energy supply to the fluorescent lamp can be interrupted upon reaching a preset critical temperature value.

12 Claims, 1 Drawing Sheet

MONITORING DEVICE

Figure 1:
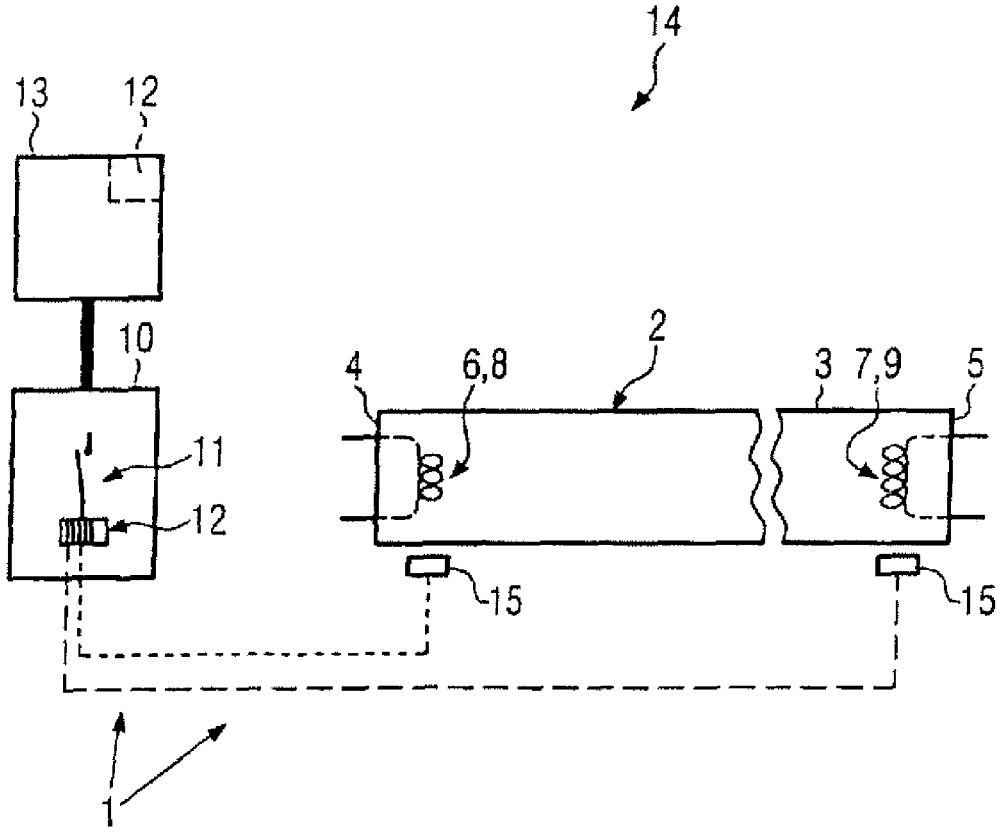

The present invention relates to a monitoring device for monitoring at least one fluorescent lamp and to a corresponding luminaire comprising such a monitoring device.

Corresponding fluorescent lamps are for instance used as explosion-protected linear fluorescent luminaires in such explosion-hazardous areas. It has been found in the operation of luminaires with such fluorescent lamps that a local overheating of the lamp base and/or the lampholder may occur. This is generally called "end-of-life" phenomenon in the case of which the inadmissible temperature rise is due to the fact that a filament as the electrode is consumed, and more and more power is needed to maintain the electrode flow for operating the fluorescent lamp.

Such inadmissible temperature rises must particularly be avoided in an explosion-hazardous area to prevent the ignition of explosive mixtures.

On account of a corresponding consumption of the filaments, the exit of the electrodes out of the material is in particular rendered difficult, which may lead to an increased voltage drop. Likewise, frequent cold starts can accelerate the consumption of the filaments. The corresponding ballast of the fluorescent lamps will then generate a great power loss upon supply with a substantially constant current, the power loss possibly leading to the increased temperature of the fluorescent lamp in the area of lamp base, lampholder and filaments.

It is the object of the present invention to avoid such a strong temperature increase in a corresponding fluorescent lamp, especially in the explosion-hazardous area, while maintaining the appropriate explosion protection.

This object is achieved with the features of claim 1.

According to this solution a temperature-measuring device is assigned to at least one filament. Furthermore, an electro-mechanical interrupting device is provided by which the power supply to the fluorescent lamp can be interrupted on reaching a predetermined critical temperature value.

Preferably, all filaments of the corresponding fluorescent lamp are monitored by a respectively assigned temperature-measuring device.

With the help of the temperature-measuring device an inadmissible temperature increase is reliably prevented in the area of the filaments. The critical temperature can here correspond to a predetermined limit value that is predetermined by the explosion protection for surface temperatures of parts of the fluorescent lamp.

According to the invention an inadmissible increase in temperature of the corresponding luminaire is reliably prevented and the luminaire can particularly be used in explosion-hazardous areas.

There is the possibility that the filaments of a fluorescent lamp are heated up to different degrees. It may here be advantageous when the temperature is sensed in the area of each filament of the corresponding fluorescent lamp. As soon as one of the corresponding temperatures exceeds the predetermined critical temperature, the supply of power will be interrupted.

It may be of advantage when the critical temperature is adjustable. A corresponding distance between filament and temperature-measuring device, which possibly leads to a systematic error of the temperature measurement, can here be taken into account. Ambient influences can also be compensated.

There is the possibility that temperature-measuring device and electro-mechanical interrupting device are configured as one part. This can e.g. be accomplished through a bimetallic switch or the like. Such a bimetallic switch is composed of two metals having different coefficients of thermal expansion. At a corresponding temperature the metals are moving apart, whereby an electrical connection is interrupted. In such a case temperature measurement and mechanical interruption of the power supply take place in one part.

There is also the possibility that a signal corresponding to the measured temperature value can be transmitted from the temperature-measuring device, which is e.g. designed as a temperature sensor, to the interrupting device. Temperature-measuring device and interrupting device are here arranged at different places. The temperature sensors transmit the signal to the interrupting device, which may e.g. be configured as a relay, particularly as a contactor, or the like. In conformity with the signal received, the power supply to the fluorescent lamp will then be interrupted.

If the temperature-measuring device is e.g. a bimetallic switch, a corresponding control current for the relay or contactor can flow through the bimetallic switch. When it reaches a temperature corresponding to the critical temperature value, the bimetallic switch will open and control current will no longer flow. The relay or contactor is thereby moved into the switch-off position, whereby the power supply is interrupted.

Such a signal of the temperature-measuring device is here called voltage interruption signal.

When the temperature value is measured in analog or digital form by the temperature measuring device and is converted into a corresponding signal, a comparing device might be needed that compares this signal with a signal corresponding to the predetermined critical temperature value. It is only when it is detected through this comparing device that the critical temperature value is reached or exceeded that the interrupting device will be driven in response to this comparison. In this instance, the interrupting device may also be a relay or contactor, but at least an electro-mechanical interrupting device.

It is also possible that the comparing device is directly assigned to the temperature measuring device, and it is also possible that the comparing device is assigned to the interrupting device and arranged each time at the corresponding place together with the temperature-measuring or interrupting device.

Since predominantly the surface temperature of the corresponding fluorescent lamp must be monitored with respect to the critical temperature, it may be regarded as sufficient when the temperature is determined from outside the lamp tube of the fluorescent lamp. This does also not require any constructional changes in the fluorescent lamp proper. However, it is also possible to integrate a corresponding temperature measuring device in the fluorescent lamp or lamp tube, respectively.

Possibilities of implementing such a temperature-measuring device are offered by a resistance temperature sensor, an infrared sensor, or the like.

Since a corresponding power supply to the fluorescent lamp takes place via the lampholder, at least the interrupting device can be arranged in the lampholder. It may be designed for explosion-hazardous areas in a correspondingly explosion-protected way, so that sparks that might arise during electro-chemical switching cannot exit out of the lampholder.

As a rule, ballasts, particularly also electric ballasts, are used for fluorescent lamps. It is also possible to arrange the interrupting device and optionally also the comparing device inside such a ballast. A corresponding electro-mechanical switching operation for interrupting the power supply may also take place there. This is carried out independently of the intrinsic function of the ballast. The ballast can here also satisfy corresponding explosion-protection conditions.

It is also possible that the interrupting device itself is configured as an explosion-protected device or is contained in another explosion-protected device.

It is conceivable that the predetermined critical temperature is predetermined by corresponding standards for explosion-protected luminaires. It is also possible that the predetermined critical temperature is determined in consideration of lamp parameters, such as arrangement and/or structure of the filaments, distance of the filaments from the lamp tube, wall thickness of the lamp tube, etc. Changes in the fluorescent lamp construction, due to which new undefined states might arise leading to an inadmissible heating, can thereby be taken into account. Moreover, the behavior of a corresponding fluorescent lamp considerably depends on ambient conditions so that the critical temperature is also determinable each time for a luminaire at a corresponding installation place. Furthermore, it is possible that the ballast, especially in the case of an electronic ballast, forms the corresponding comparing device due to its own "intelligence" and is used for driving the electro-mechanical interrupting device.

The present invention also relates to a luminaire with a corresponding monitoring device of the above-described kind.

An advantageous embodiment of the invention shall now be described in more detail with reference to the FIGURE attached in the drawing.

FIG. 1 is a block diagram of an embodiment of a monitoring device with temperature-measuring devices.

FIG. 1 shows a luminaire 14 as a block diagram. The luminaire comprises at least one fluorescent lamp 2. Such a fluorescent lamp 2 comprises a lamp tube 3 at the ends 4 and 5 of which corresponding electrodes 6 and 7 are arranged in the form of filaments 8 and 9. To monitor the temperature of the corresponding filaments 8, 9, temperature-measuring devices 15, e.g. in the form of a measuring resistor, a bimetallic temperature sensor, an infrared sensor, or the like, are arranged in neighboring fashion and outside of the lamp tube. These serve to continuously monitor the temperature of the corresponding filaments 8, 9. Signals corresponding to the respectively measured temperature value are transmitted via lines to an electro-mechanical interrupting device 11.

If the corresponding temperature measuring device is e.g. configured as a bimetallic switch, a corresponding voltage interruption signal is transmitted to the interrupting device 11 when the predetermined critical temperature value is reached. In the case of a bimetallic switch said voltage interruption signal may be a zero voltage signal by which a relay or contactor as the interrupting device gets de-energized and, as a result, opens a corresponding contact. Due to the opening of this contact the power supply of the fluorescent lamp 2 is interrupted, and an overheating of the filaments, the lamp base and possibly the lampholder, which is called "end-of-life" phenomenon, is thereby prevented.

It is also possible that the corresponding signal from the temperature-measuring device is only compared by means of a comparing device 12 with a signal corresponding to the predetermined critical temperature value and the electro-mechanical interrupting device 11 is driven in response to said comparison.

When a bimetallic switch is used, it is possible that said switch substantially forms temperature measuring device and electro-mechanical interrupting device 11 as one part, so that there is no need for a bipartite construction of these devices with additional signal transmission.

The comparing device 12 can be assigned to both the temperature-measuring device 15 and the electro-mechanical interrupting device 11. In the case of an assignment to the interrupting device the corresponding comparison can be made separately in the comparing device for both temperature-measuring devices 15.

The comparing device 12 can be arranged next to the interrupting device 11 and together with said device in a housing, such as e.g. in a lampholder 10.

Since the monitoring device 1 according to the invention is particularly provided for explosion-hazardous areas, at least the interrupting device 11 is configured for maintaining a corresponding explosion protection. This can be carried out in that the corresponding lampholder 10, in which the interrupting device 11 is arranged, is configured as an Ex-lampholder. Other types of explosion protection are also feasible.

At least for the explosion-hazardous area, spark breakdown, which possibly occurs during switching of the electro-mechanical interrupting device 11, must be avoided to the outside in the explosion-hazardous area.

It is also possible that the interrupting device 11 is assigned to a ballast 13 or is arranged in said ballast. Such a ballast is needed in fluorescent lamps 2 for the operation thereof. Nowadays, an electronic ballast with its own "intelligence" is used as a rule. This "intelligence" can also assume the function of the comparing device 12, so that a corresponding drive of the electro-mechanical interrupting device 11 can also be carried out by the ballast 13. This is marked in FIG. 1 by the dashed arrangement of the comparing device 12 inside the ballast 13.

In the illustrated embodiment the temperature-measuring devices 15 are arranged outside the lamp tube 13 and next to the filaments 8, 9. It is also possible to improve the assignment of the temperature-measuring devices to the respective filament by arranging the temperature-measuring devices inside the lamp tube 3. However, this requires constructional changes within the lamp tube. To be able to monitor already installed fluorescent lamps or lamp tubes with the monitoring device 1 according to the invention, an arrangement of the temperature-measuring device 15 outside the lamp tube 3 is of advantage as this does not require any constructional changes in the fluorescent lamp 2.

Furthermore, there is the possibility that the monitoring device 1 can be assigned as an additional component to each luminaire 4 with fluorescent lamp 2 and lamp tube 3 and also lampholders and ballast. It is also possible that the monitoring device 1 forms part of a corresponding luminaire 14, i.e. it is integrated into said luminaire in an appropriate way.

The monitoring device 1 according to the invention as shown in FIG. 1 is configured such that after interruption of the power supply to the fluorescent lamp 2 and after exchange of the fluorescent lamp 2 a renewed operation of the luminaire 14 with a new fluorescent lamp 2 is possible. Thus a reversible interruption of the power supply takes place.

According to the invention the corresponding critical temperature value can also be changed, for instance in order to take into account changes in a fluorescent lamp design, new undefined states possibly leading to inadmissible heating, etc. Such states are e.g. arrangement or structure of the filaments, the distance of the filaments from the lamp tube, wall thickness of the lamp tube, or the like.

When the critical temperature is determined, corresponding ambient conditions of the respective fluorescent lamp can be taken into account if these have an influence on the ambient temperature or the heating up of the fluorescent lamp, and the position of use of the lamp can here also be taken into account.

Thus, according to the invention the "end-of-life" phenomenon is reliably avoided in a simple constructional way, and it is here possible to retrofit correspondingly existing luminaires with the monitoring device 1 according to the invention and also to install corresponding monitoring devices 1 together with luminaires.

The invention claimed is:

1. A monitoring device for monitoring at least one fluorescent lamp in explosion-hazardous areas, which fluorescent lamp comprises a lamp tube with electrodes arranged at its ends in the form of filaments, and lampholders assigned thereto, wherein the monitoring device comprises at least one temperature-measuring device assigned to a filament, and an electro-mechanical interrupting device by means of which the power supply to the fluorescent lamp can be interrupted on reaching a predetermined critical upper temperature value.

2. The monitoring device according to claim 1, wherein the critical temperature value is adjustable.

3. The monitoring device according to claim 1, wherein the temperature-measuring device and the electro-mechanical interrupting device are designed as one piece.

4. The monitoring device according to claim 1, wherein a temperature-measuring device is assigned to each filament and the power supply can be switched off by the interrupting device upon detection by means of at least one temperature device that the critical temperature value has been reached.

5. The monitoring device according to claim 1, wherein a signal corresponding to the measured temperature value can be transmitted by the temperature-measuring device to the interrupting device.

6. The monitoring device according to claim 5, wherein the signal is a voltage interruption signal.

7. The monitoring device according to claim 5, wherein the signal is comparable through a comparing device with a signal corresponding to the predetermined critical temperature value and the interrupting device is drivable in dependence upon the comparison.

8. The monitoring device according to claim 1, wherein at least the interrupting device is arranged in a lampholder.

9. The monitoring device according to claim 1, wherein the critical temperature value can be predetermined in dependence upon lamp parameters such as arrangement of the filaments, structure of the filaments, distance of the filaments from the lamp tube, or wall thickness of the lamp tube.

10. The monitoring device according to claim 1, wherein at least the interrupting device is arranged in a ballast.

11. The monitoring device according to claim 1, wherein the interrupting device is configured as an Ex-device or contained in an Ex-device.

12. A luminaire comprising at least one fluorescent lamp and a monitoring device according to claim 1.

* * * * *